US011106159B2

(12) United States Patent
Ao et al.

(10) Patent No.: US 11,106,159 B2
(45) Date of Patent: Aug. 31, 2021

(54) BELT DRIVING DEVICE, TRANSFER DEVICE, AND IMAGE FORMING APPARATUS

(71) Applicant: FUJIFILM Business Innovation Corp., Tokyo (JP)

(72) Inventors: Satoshi Ao, Kanagawa (JP); Daisuke Tanaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/864,285

(22) Filed: May 1, 2020

(65) Prior Publication Data

US 2021/0132525 A1 May 6, 2021

(30) Foreign Application Priority Data

Oct. 30, 2019 (JP) ..... JP2019-197114

(51) Int. Cl.
*G03G 15/16* (2006.01)

(52) U.S. Cl.
CPC ..... *G03G 15/1615* (2013.01); *G03G 15/167* (2013.01); *G03G 2215/00143* (2013.01); *G03G 2215/00151* (2013.01); *G03G 2215/1623* (2013.01)

(58) Field of Classification Search
CPC ..... G03G 15/1615; G03G 15/167; G03G 2215/1623; G03G 15/161; G03G 2215/0122; G03G 2215/0129; G03G 2215/1661; G03G 2215/00143; G03G 2215/00151
See application file for complete search history.

(56) References Cited

U.S. PATENT DOCUMENTS 6,053,832 A * 4/2000 Saito ..... F16H 7/18 474/122
6,970,674 B2 11/2005 Sato et al.
(Continued)

FOREIGN PATENT DOCUMENTS

DE 3138755 C2 * 8/1987 ..... B65H 23/02
JP 2002-333779 A 11/2002
(Continued)

*Primary Examiner* — Walter L Lindsay, Jr.
*Assistant Examiner* — Laura Roth
(74) *Attorney, Agent, or Firm* — Sughrue Mion, PLLC

(57) ABSTRACT

A belt driving device includes plural rotating members around which a belt member extends, each rotating member rotating about a rotating shaft; and contact members disposed at both sides of the belt member in a width direction. The rotating members include a first rotating member, having a dimension less than a width of the belt member in a direction of the rotating shaft. Each contact member has a first contact point at which the contact member contacts the belt member and a second contact point closer to a corresponding one of the end portions in the width direction than the first contact point and at which the contact member contacts the belt member such that an angle between the contact member and the rotating shaft at the second contact point is greater than an angle between the contact member and the rotating shaft at the first contact point.

17 Claims, 11 Drawing Sheets

(56) References Cited

U.S. PATENT DOCUMENTS

| | | | | |
|---|---|---|---|---|
| 2003/0175056 | A1* | 9/2003 | Sato | G03G 15/1615 399/302 |
| 2005/0254855 | A1* | 11/2005 | Inaba | G03G 15/1615 399/113 |
| 2006/0054467 | A1* | 3/2006 | Oishi | G03G 15/2053 198/835 |
| 2009/0317153 | A1* | 12/2009 | Lee | G03G 15/2053 399/329 |
| 2015/0261136 | A1* | 9/2015 | Tanaka | G03G 15/161 399/101 |

FOREIGN PATENT DOCUMENTS

| | | | |
|---|---|---|---|
| JP | 2003-267580 | A | 9/2003 |
| JP | 2005-257863 | A | 9/2005 |
| JP | 2005-316257 | A | 11/2005 |

* cited by examiner

BELT DRIVING DEVICE, TRANSFER DEVICE, AND IMAGE FORMING APPARATUS

CROSS-REFERENCE TO RELATED APPLICATIONS

This application is based on and claims priority under 35 USC 119 from Japanese Patent Application No. 2019-197114 filed Oct. 30, 2019.

BACKGROUND

(i) Technical Field

The present disclosure relates to a belt driving device, a transfer device, and an image forming apparatus.

(ii) Related Art

An apparatus that drives a loop-shaped belt member that extends around plural rotating members may cause a lateral deviation of the belt member, which is a deviation of the belt member in a width direction, that is, a direction of rotating shafts of the rotating members. The lateral deviation is caused by a force generated when the rotating shafts of the rotating members are not parallel to each other. To reduce the lateral deviation, guide members have been proposed with which end portions of the belt member in the width direction are pressed in a direction at an angle with respect to the rotating shafts (see Japanese Unexamined Patent Application Publication No. 2003-267580 and Japanese Unexamined Patent Application Publication No. 2005-257863).

When the guide members proposed in the above-mentioned Japanese Unexamined Patent Application Publication No. 2003-267580 and Japanese Unexamined Patent Application Publication No. 2005-257863 are provided, the lateral deviation of the belt member is less than when no guide members are provided.

However, the above-described guide members may not be able to sufficiently reduce the lateral deviation when the rotating shafts of the rotating members are greatly displaced from parallel positions and when the force that causes the lateral deviation is large. Also, an arrangement in which the rotating shafts of the rotating members are accurately parallel to each other may involve an increase in cost.

SUMMARY

Aspects of non-limiting embodiments of the present disclosure relate to a belt driving device, a transfer device, and an image forming apparatus in which the lateral deviation is further reduced compared to when the above-described guide members are provided.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a belt driving device including a belt member that is loop-shaped; plural rotating members around which the belt member extends, each rotating member rotating about a rotating shaft that extends in a width direction of the belt member; and contact members disposed at both sides of the belt member in the width direction, the contact members being in contact with the belt member and reducing a deviation of the belt member in the width direction. The plurality of rotating members include at least one first rotating member, a portion of the first rotating member that is in contact with the belt member having a dimension less than a width of the belt member in a direction of the rotating shaft so that end portions of the belt member in the width direction are spaced from the first rotating member. Each contact member has at least a first contact point at which the contact member is in contact with the belt member and presses the belt member against the first rotating member and a second contact point that is closer to a corresponding one of the end portions in the width direction than the first contact point is and at which the contact member is in contact with the belt member such that an angle between the contact member and the rotating shaft is greater than an angle between the contact member and the rotating shaft at the first contact point.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will now be described.

Figure 1:
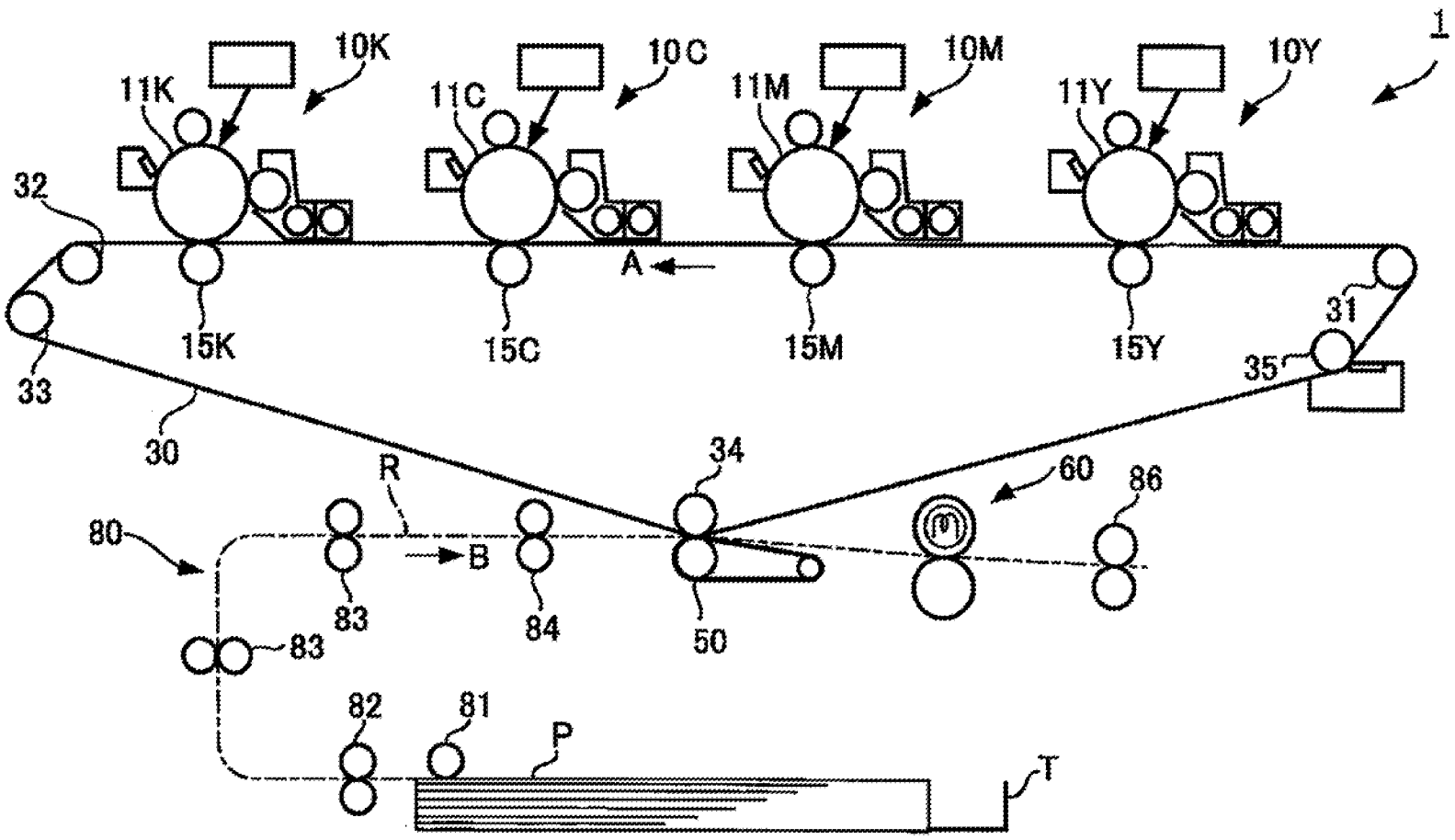
FIG. 1 is a schematic diagram illustrating an image forming apparatus according to an exemplary embodiment of the present disclosure.

FIG. 1 is a schematic diagram illustrating an image forming apparatus according to the exemplary embodiment of the present disclosure.

The image forming apparatus 1 illustrated in FIG. 1 is a so-called tandem color printer. The image forming apparatus 1 uses a paper sheet P as a recording medium. The recording medium may be plastic paper or an envelope instead of the paper sheet P. In the following description, the paper sheet P will be described as a typical example of the recording medium.

The image forming apparatus 1 includes four image engines 10Y, 10M, 10C, and 10K corresponding to four colors, which are, for example, yellow (Y), magenta (M), cyan (C), and black (K). In the present exemplary embodiment, each of the image engines 10Y, 10M, 10C, and 10K forms a toner image with a so-called electrophotographic system. The image engines 10Y, 10M, 10C, and 10K perform charging, exposure, and developing processes successively to form toner images of the respective colors on photoconductor drums 11Y, 11M, 11C, and 11K, respectively.

The image forming apparatus 1 according to the present exemplary embodiment employs an indirect transfer method, and includes an intermediate transfer belt 30. The image forming apparatus 1 also includes a second transfer device 50, a fixing device 60, and a sheet transport unit 80.

The intermediate transfer belt 30 is an endless belt that extends around belt support rollers 31 to 35, and rotates counterclockwise as shown by arrow A through the image engines 10Y, 10M, 10C, and 10K and the second transfer device 50.

The image engines 10Y, 10M, 10C, and 10K respectively include first transfer rollers 15Y, 15M, 15C, and 15K at positions such that the first transfer rollers 15Y, 15M, 15C, and 15K respectively face the photoconductor drums 11Y, 11M, 11C, and 11K with the intermediate transfer belt 30 interposed therebetween. The first transfer rollers 15Y, 15M, 15C, and 15K electrostatically attract the toner images on the photoconductor drums 11Y, 11M, 11C, and 11K to the intermediate transfer belt 30 when a voltage is applied thereto. The toner images of the respective colors formed by the image engines 10Y, 10M, 10C, and 10K are successively transferred to and superposed on the intermediate transfer belt 30 by the first transfer rollers 15Y, 15M, 15C, and 15K. As a result of this transfer process, a color image is formed on the intermediate transfer belt 30. The intermediate transfer belt 30 having the color image formed thereon moves to transport the color image to the second transfer device 50.

The second transfer device 50 is positioned such that the intermediate transfer belt 30 is interposed between the second transfer device 50 and a backup roller 34, which is one of the belt support rollers 31 to 35. The second transfer device 50 transfers the color image to the paper sheet P placed between the second transfer device 50 and the intermediate transfer belt 30.

A stack of paper sheets P is placed in a sheet tray T disposed in a lower section of the image forming apparatus 1. The paper sheets P in the sheet tray T are fed from the sheet tray T one at a time by a pickup roller 81 and separating rollers 82 included in the sheet transport unit 80. Then, each paper sheet P is transported in the direction of arrow B along a transport path R by transport rollers 83. The sheet transport unit 80 also includes registration rollers 84 that feed the paper sheet P to the second transfer device 50 at a time corresponding to when the color image is transported by the intermediate transfer belt 30.

As described in detail below, the second transfer device 50 transfers the color image on the intermediate transfer belt 30 to the paper sheet P when a voltage is applied thereto. The second transfer device 50 is a belt driving device according to the exemplary embodiment of the present disclosure, and is also a transfer device according to the exemplary embodiment of the present disclosure. The paper sheet P to which the color image has been transferred by the second transfer device 50 is transported to the fixing device 60 by the second transfer device 50 and the transport rollers 83 included in the sheet transport unit 80.

The image engines 10Y, 10M, 10C, and 10K are each an example of an image forming unit according to the present disclosure. The sheet transport unit 80 is an example of a transport unit according to the present disclosure.

The fixing device 60 applies heat and pressure to the paper sheet P to fix the color image to the paper sheet P. The paper sheet P having the color image fixed thereto by the fixing device 60 is transported to the outside of the image forming apparatus 1 by discharge rollers 86 included in the sheet transport unit 80.

The second transfer device 50 will now be described in more detail.

Figure 2:
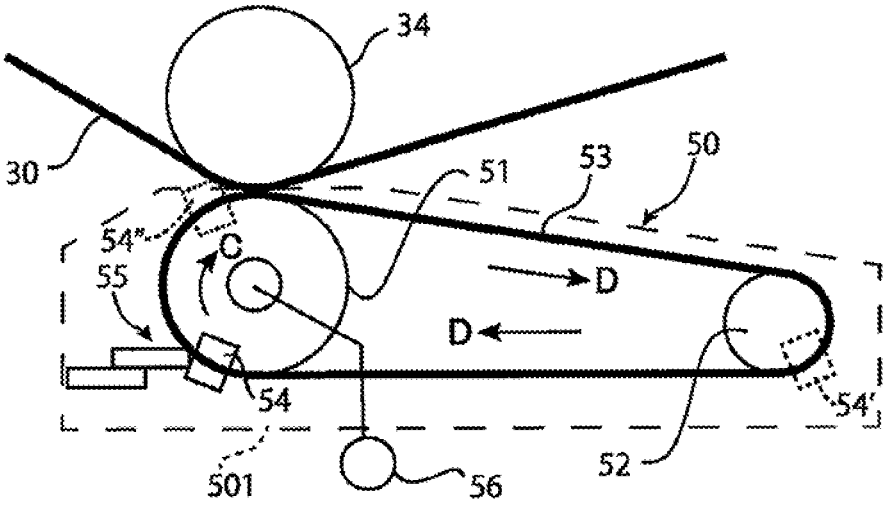
FIG. 2 is a schematic side view illustrating the structure of a second transfer device.
Figure 3:
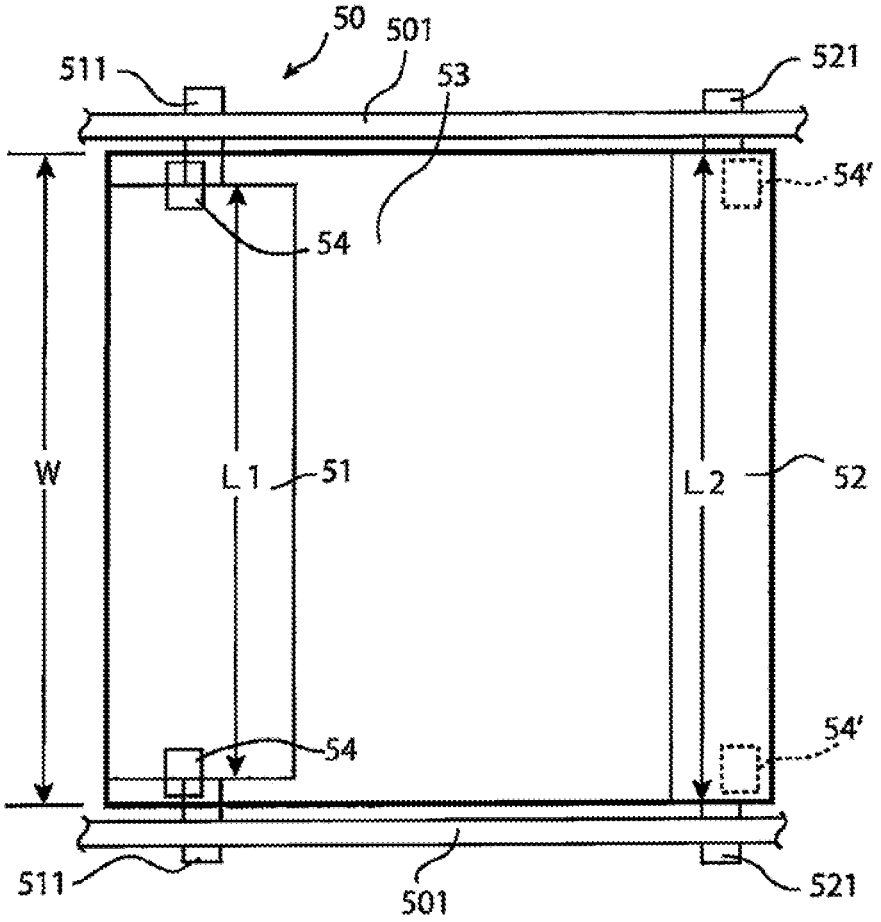
FIG. 3 is a schematic top view illustrating the structure of the second transfer device.

FIGS. 2 and 3 are schematic diagrams illustrating the structure of the second transfer device 50. FIG. 2 shows a side view, and FIG. 3 shows a top view. FIG. 3 illustrates the internal structure of the second transfer device 50 in a see-through view for the convenience of description.

The second transfer device 50 includes a transfer roller 51, a separation roller 52, and an endless transfer belt 53 that extends around these rollers. The second transfer device 50 is a unit in which the components are assembled to a transfer device support frame 501. The transfer roller 51 and the separation roller 52 respectively include rotating shafts 511 and 521. The rotating shafts 511 and 521 are rotatably supported by the transfer device support frame 501. The transfer roller 51 and the separation roller 52 correspond to an example of plural rotating members according to the present disclosure, and the transfer belt 53 corresponds to an example of a belt member according to the present disclosure.

The transfer roller 51 is driven by a transfer motor 56 and rotates clockwise in the direction shown by arrow C to drive the transfer belt 53. The transfer belt 53, which is a suitably elastic rubber belt, receives a driving force from the transfer roller 53 and rotates clockwise in the direction shown by arrow D in FIG. 2.

The transfer roller 51 presses the transfer belt 53 against the intermediate transfer belt 30 from the inside of the transfer belt 53. When the paper sheet P is transported to a position between the transfer belt 53 and the intermediate transfer belt 30 that are pressed against each other, the paper sheet P is nipped between the transfer belt 53 and the intermediate transfer belt 30 and transported in the rotating direction. The transfer roller 51 is connected to a power supply (not shown), and receives a transfer bias from the power supply. When the paper sheet P moves through the position between the transfer belt 53 and the intermediate transfer belt 30, the color image on the intermediate transfer belt 30 is transferred to the paper sheet P due to the transfer bias.

The separation roller 52 is a driven roller having a diameter less than that of the transfer roller 51, and is rotated by the movement of the transfer belt 53. The direction in which the transfer belt 53 moves is suddenly changed due to the separation roller 52, so that the leading end of the paper sheet P placed on the transfer belt 53 is separated from the transfer belt 53.

A portion of the transfer roller 51 that excludes the rotating shaft 511 and that is in contact with the transfer belt 53 has a length L1 less than a width W of the transfer belt 53, and both end portions of the transfer belt 53 protrude from the transfer roller 51 and are not in contact with the transfer roller 51. Contact members 54 are provided at the end portions of the transfer roller 51. The contact members 54 are in contact with the transfer belt 53 to press the transfer belt 53 against the transfer roller 51. The contact members 54 have a function of reducing the lateral deviation of the transfer belt 53 in the width direction of the transfer belt 53 (direction in which the rotating shaft 511 of the transfer roller 51 extends).

A portion of the separation roller 52 that excludes the rotating shaft 521 and that is in contact with the transfer belt 53 has a length L2 that is greater than the length L1 of the transfer roller 51. In the present exemplary embodiment, the length L2 is equal to the width W.

The details of the contact members 54 and the effect of the difference in length between the transfer roller 51 and the separation roller 52 will be described below.

The second transfer device 50 also includes a cleaning blade 55 that is in contact with an outer peripheral surface of the transfer belt 53 at an edge of the cleaning blade 55. The position of the cleaning blade 55 with respect to the transfer device support frame 501 is fixed so that the edge of the cleaning blade 55 slides along the outer peripheral surface of the transfer belt 53 when the transfer belt 53 moves. The toner and dust that have adhered to the transfer belt 53 are scraped off the transfer belt 53 by the cleaning blade 55.

The cleaning blade 55 and the transfer motor 56 are not illustrated in FIG. 3.

Figure 4A:
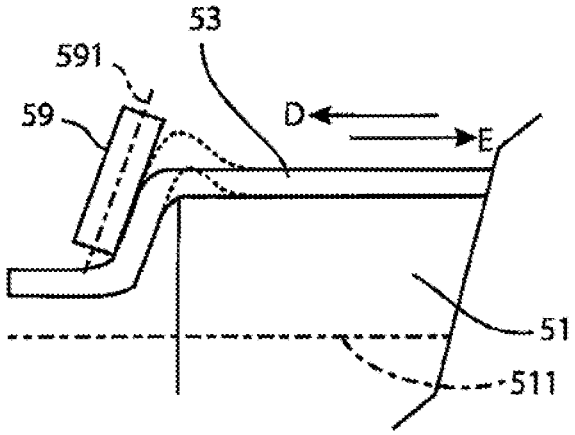
FIG. 4A RELATED ART
FIG. 4A illustrates a contact member according to a comparative example.
Figure 4B:
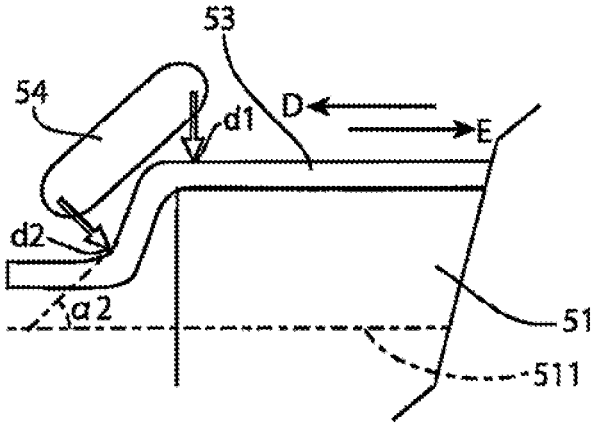
FIG. 4B illustrates the principle of a contact member according to the exemplary embodiment.

FIG. 4A illustrates a contact member 59 according to a comparative example, and FIG. 4B illustrates the principle of the contact member 54 according to the present exemplary embodiment. Although FIGS. 4A and 4B illustrate only one end in the width direction of the transfer belt 53, the other end has a similar structure.

When the rotating shaft 511 of the transfer roller 51 and the rotating shaft 521 of the separation roller 52 are displaced from parallel positions, a force that moves the transfer belt 53 in the width direction thereof (direction in which the rotating shaft 511 of the transfer roller 51 extends) and that causes a lateral deviation of the transfer belt 53 is generated. Whether the moving direction is leftward or rightward along the width direction differs depending on the directions of the displacements from the parallel positions. Here, it is assumed that a force is applied in a direction toward the end illustrated in FIGS. 4A and 4B (direction of arrow D).

FIG. 4A illustrates the contact member 59 that is flat plate-shaped as a comparative example. The contact member 59 according to the comparative example may instead be a roller that freely rotates about a rotational axis 591 and has a constant diameter along the rotational axis 591.

Referring to FIG. 4A, when the contact member 59 presses the transfer belt 53 in a direction at an angle with respect to the rotating shaft 511 of the transfer roller 51, the transfer belt 53 that tries to move in the direction of arrow D receives a pushing force that pushes back the transfer belt 53 in the direction of arrow E. As the pushing force increases, a greater moving force in the direction of arrow D may be resisted. When a large moving force in the direction of arrow D may be resisted, the parallelism between the transfer roller 51 and the separation roller 52 may be reduced. This means that reduction in cost may be achieved by reducing the component accuracies and increasing the assembly tolerance.

According to the comparative example illustrated in FIG. 4A, the pushing force is applied by the contact member 59, which is flat plate-shaped or has the shape of a roller with a constant diameter. Even when the contact member 59 having such a shape is used, a large pushing force can be generated compared to when the contact member 59 is not provided. Accordingly, the component accuracies may be reduced and the assembly tolerance may be increased.

However, when a large moving force is applied in the direction of arrow D, the transfer belt 53 is raised from the transfer roller 51 as shown by the broken lines. This causes a reduction in the pushing force that pushes back the transfer belt 53. Accordingly, a contact member capable of resisting a greater moving force in the direction of arrow D is desired.

FIG. 4B does not illustrate the shape of the contact member 54. The shape of the contact member 54 will be described below with reference to FIG. 5A and the following figures.

The contact member 54 illustrated in FIG. 4B has a first contact point d1 at which the contact member 54 is in contact with the transfer belt 53 and presses the transfer belt 53 against the transfer roller 51 and a second contact point d2 that is closer to the end portion of the transfer belt 53 in the width direction than the first contact point d1 is and at which the contact member 54 is in contact with the transfer belt 53 such that an angle $\alpha 2$ between the contact member 54 and the rotating shaft 511 is greater than that at the first contact point d1. As a typical example, at the first contact point d1, the transfer belt 53 is pressed in a direction such that an angle $\alpha 1$ between the contact member 54 and the rotating shaft 511 is 0°, that is, such that the contact member 54 is parallel to the rotating shaft 511. At the second contact point d2, the transfer belt 53 is pressed in a direction such that the angle $\alpha 2$ between the contact member 54 and the rotating shaft 511 is 45°. Thus, the transfer belt 53 is prevented from swelling as shown by the dotted lines in FIG. 4A, and a greater moving force in the direction of arrow D may be resisted than when the flat plate-shaped contact member 59 illustrated in FIG. 4A is used. The angle $\alpha 1$ between the contact member 54 and the rotating shaft 511 at the first contact point d1 is not limited to 0°. For example, the angle $\alpha 1$ may be 15°, and the transfer belt 53 may be pressed at an angle less than the angle $\alpha 2$ at the second contact point d2.

Examples of the contact member according to the present exemplary embodiment will now be described.

Figure 5A:
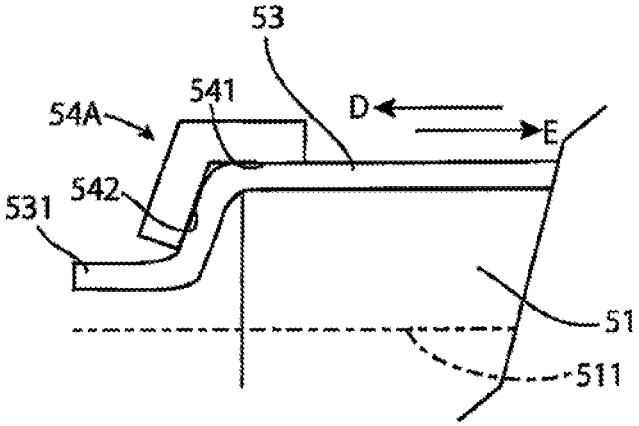
FIG. 5A illustrates a first example of the contact member.
Figure 5B:
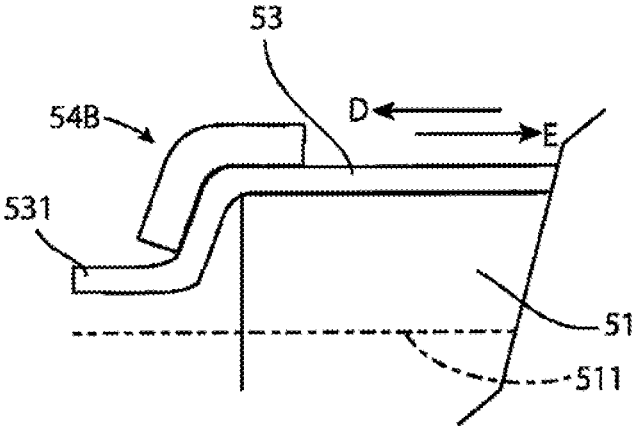
FIG. 5B illustrates a second example of the contact member.

FIGS. 5A and 5B respectively illustrate a contact member 54A according to a first example and a contact member 54B according to a second example.

The contact member 54A according to the first example illustrated in FIG. 5A has the shape of a bent flat plate. This contact member 54A has a first surface 541 that faces inward and that is parallel to the rotating shaft 511, and is disposed such that the first surface 541 and a second surface 542 thereof are in contact with the transfer belt 53. The transfer belt 53 rotates while sliding along the contact member 54A.

An endmost portion 531 of the transfer belt 53 in the width direction that is spaced from the contact member 54A is bent in a direction opposite to the direction in which the transfer belt 53 is bent by the contact member 54A, that is, so that the endmost portion 531 becomes parallel to the rotating shaft 511. When the endmost portion 531 of the transfer belt 53 in the width direction is bent in this direction, the rigidity of a portion of the transfer belt 53 that is pressed by the contact member 54A is increased so that the counterforce against the moving force in the direction of arrow D can be increased. As illustrated in FIG. 3, according to the present exemplary embodiment, the length L2 of the separation roller 52 is greater than the length L1 of the transfer roller, and is substantially equal to the width W of the transfer belt 53. Therefore, the end portions of the transfer belt 53 in the width direction are more strongly pulled by the separation roller 52 than when the separation roller 52 has the same length as that of the transfer roller 51. Accordingly, the endmost portion 531 of the transfer belt 53 is strongly bent in the direction opposite to the direction in which the transfer belt 53 is bent by the contact member 54A, that is, so that the endmost portion 531 becomes parallel to the rotating shaft 511. Thus, the rigidity of each end portion of the transfer belt 53 is further increased. This applies to all of the contact members according to the second and the following examples, and redundant description will be omitted.

The contact member 54B according to the second example illustrated in FIG. 5B has the shape of a bent flat plate having a curved surface. The contact member 54B is disposed such that a portion thereof that is closest to the center of the transfer belt 53 in the width direction is parallel to the rotating shaft 511 and such that a surface thereof that faces inward is in contact with the transfer belt 53 over the entire area thereof. Similar to the first example illustrated in FIG. 5A, the transfer belt 53 rotates while sliding along the contact member 54B.

The contact member 54B according to the second example is in contact with the transfer roller 53 at many successive points at different positions in the width direction, the points including the first contact point d1 and the second contact point d2 described above with reference to FIG. 4B. Accordingly, a portion of the transfer belt 53 that is in contact with the contact member 54B may be maintained in a desired shape.

The contact member according to the present disclosure may be a member along which the transfer belt 53 slides, as are the contact members 54A and 54B according to the first and second examples.

Figure 6A:
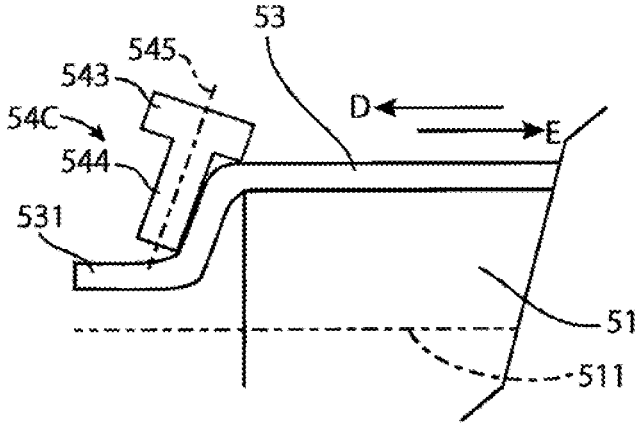
FIG. 6A illustrates a third example of the contact member.
Figure 6B:
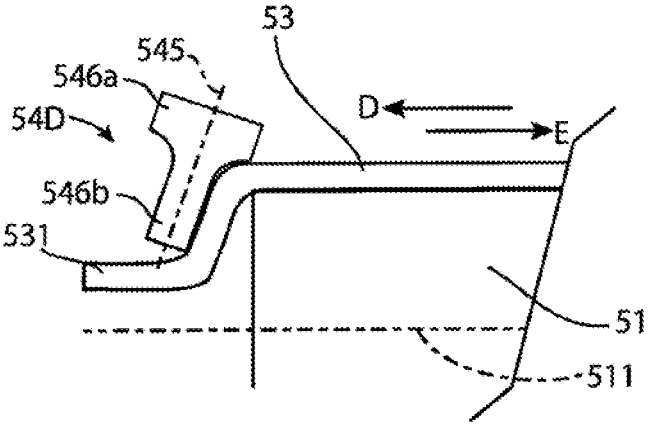
FIG. 6B illustrates a fourth example of the contact member.

FIGS. 6A and 6B respectively illustrate a contact member 54C according to a third example and a contact member 54D according to a fourth example.

The contact member 54C according to the third example illustrated in FIG. 6A is a roller that freely rotates about a rotational axis 545 and that has two portions having different diameters, which are a large diameter portion 543 and a small diameter portion 544. As illustrated in FIG. 6A, the contact member 54C is positioned such that the transfer belt 53 is pressed by the large diameter portion 543 in a direction perpendicular to the rotating shaft 511 of the transfer roller 51 and is pressed obliquely inward by the small diameter portion 544.

The contact member 54C according to the third example illustrated in FIG. 6A is in contact with the transfer belt 53 and freely rotates as the transfer belt 53 moves. Therefore, the risk that the transfer belt 53 cannot move smoothly is less than when the contact members 54A and 54B illustrated in FIGS. 5A and 5B along which the transfer belt 53 slides are used.

Similar to the contact member 54C according to the third example, the contact member 54D according to the fourth example illustrated in FIG. 6B is a roller that freely rotates about a rotational axis 545. The contact member 54D according to the fourth example is formed such that one end portion 546*a* thereof in the direction of the rotational axis 545 has a maximum diameter and that the other end portion 546*b* thereof has a minimum diameter. A concavely curved outer surface is provided between the end portions 546*a* and 546*b*.

The outer surface of the contact member 54D including the concavely curved surface is in contact with the transfer roller 53 at many successive points at different positions in the width direction, the points including the first contact point d1 and the second contact point d2 described above with reference to FIG. 4B. Accordingly, similar to the contact member 54B according to the second example, a portion of the transfer belt 53 that is in contact with the contact member 54B may be maintained in a desired shape.

Figure 7:
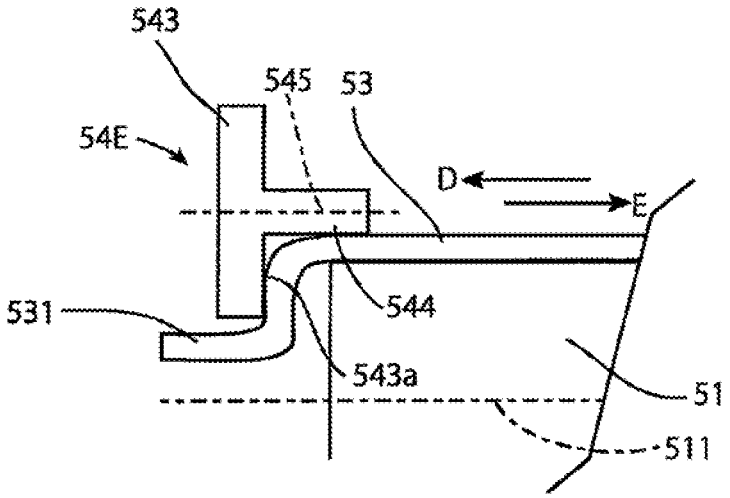
FIG. 7 illustrates a fifth example of the contact member.

FIG. 7 illustrates a contact member 54E according to a fifth example.

The contact member 54E according to the fifth example illustrated in FIG. 7 is a roller that freely rotates about a rotational axis 545. The contact member 54E includes a large diameter portion 543 and a small diameter portion 544, and is T-shaped in a sectional view taken along a plane including the rotational axis 545. As illustrated in FIG. 7, the contact member 54E is disposed such that the rotational axis 545 is parallel to the rotating shaft 511 of the transfer roller 51. The small diameter portion 544 presses the transfer belt 53 in a direction perpendicular to the rotating shaft 511, and the large diameter portion 543 has a side surface 543*a* that presses the transfer belt 53 in a lateral direction.

Figure 8A:
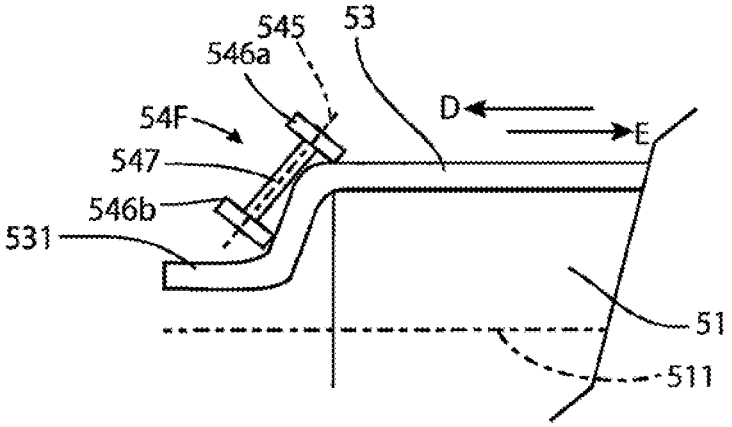
FIG. 8A illustrates a sixth example of the contact member.
Figure 8B:
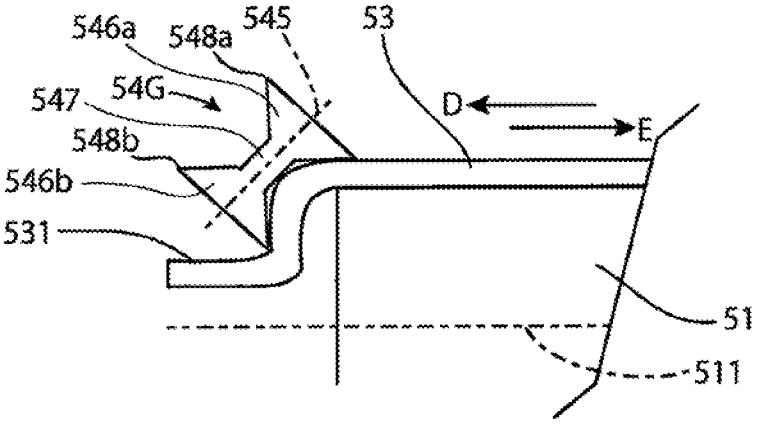
FIG. 8B illustrates a seventh example of the contact member.

FIGS. 8A and 8B respectively illustrate a contact member 54F according to a sixth example and a contact member 54G according to a seventh example.

Figure 9A:
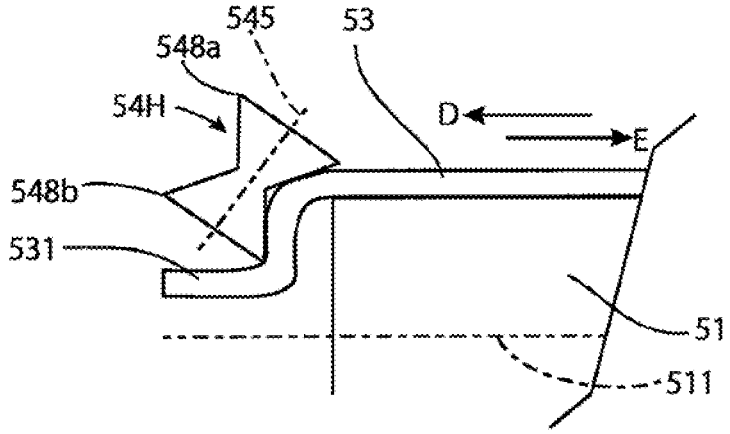
FIG. 9A illustrates an eighth example of the contact member.
Figure 9B:
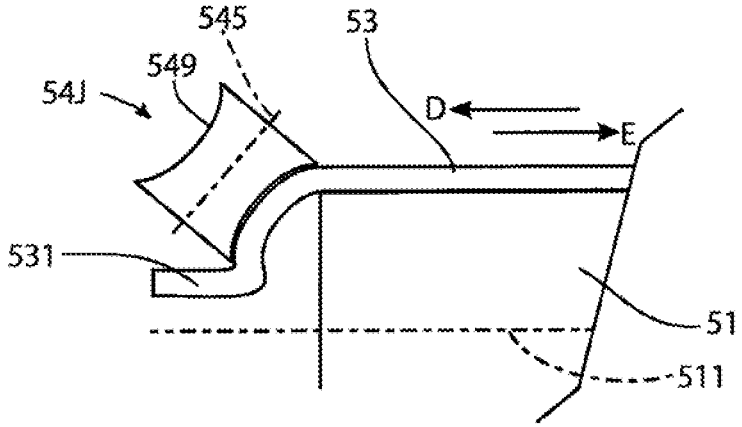
FIG. 9B illustrates a ninth example of the contact member.

FIGS. 9A and 9B respectively illustrate a contact member 54H according to an eighth example and a contact member 54J according to a ninth example.

The contact members 54F, 54G, 54H, and 54J according to the sixth, seventh, eighth, and ninth examples illustrated in FIGS. 8A, 8B, 9A, and 9B are each a roller that freely rotates about a rotational axis 545 and has a diameter smaller at the center thereof than at both ends thereof in the direction of the rotational axis 545. Each example will be described.

The contact member 54F according to the sixth example illustrated in FIG. 8A is shaped such that end portions 546*a* and 546*b* thereof in the direction of the rotational axis 545 have a large diameter and that a central portion 547 thereof disposed between the end portions 546*a* and 546*b* has a small diameter. As illustrated in FIG. 8A, the contact member 54F is disposed such that the transfer belt 53 is pressed by one end portion 546*a* in a direction perpendicular to the rotating shaft 511 of the transfer roller 51 and is pressed obliquely inward by the other end portion 546*b*.

The contact member 54G according to the seventh example illustrated in FIG. 8B is shaped such that end portions 546*a* and 546*b* thereof in the direction of the rotational axis 545 have conical shapes with the diameter decreasing from edges 548*a* and 548*b* toward the center and that a central portion 547 disposed between the end portions 546*a* and 546*b* has a cylindrical shape with a small diameter. As illustrated in FIG. 8B, the contact member 54G is disposed such that the transfer belt 53 is pressed against the transfer roller 51 by one end portion 546*a* and is pressed obliquely inward by the other end portion 546*b*.

The contact member 54H according to the eighth example illustrated in FIG. 9A is shaped such that the diameter thereof decreases from both edges 548*a* and 548*b* toward the center in the direction of the rotational axis 545 to form conical shapes and that the contact member 54H has a minimum diameter at the center. As illustrated in FIG. 9A, the contact member 54H is disposed such that the transfer belt 53 is pressed against the transfer roller 51 by a portion thereof close to one edge 548*a*, and is pressed obliquely inward by a portion thereof close to the other edge 548*b*.

The contact member 54J according to the ninth example illustrated in FIG. 9B has an outer peripheral surface 549 that is curved such that the contact member 54J is thinned toward the center in the direction of the rotational axis 545. As illustrated in FIG. 9B, the contact member 54J is disposed such that the transfer belt 53 is pressed by the outer peripheral surface 549 thereof over the entire region in the direction of the rotational axis 545.

As illustrated in FIG. 5A to FIG. 9B, contact members having various shapes may be used as the contact member 54 according to the present exemplary embodiment.

Bearings used when the contact member 54 is a roller that freely rotates will now be described.

Figure 10:
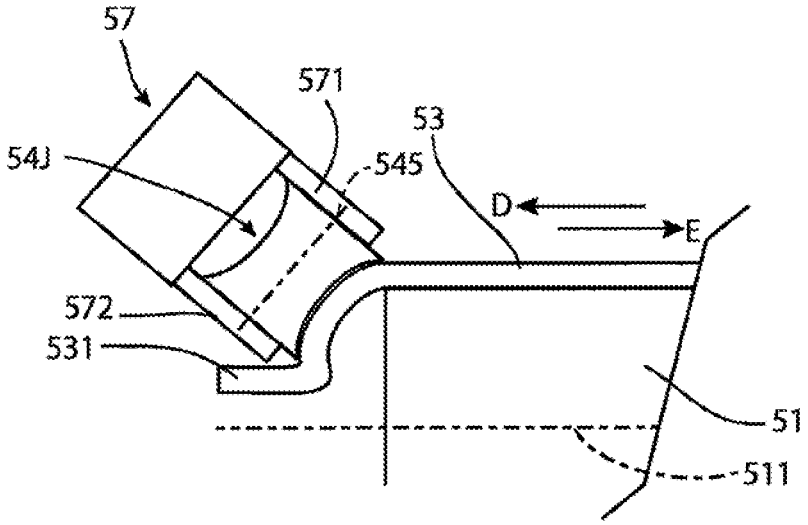
FIG. 10 is a schematic diagram illustrating a roller-shaped contact member and a support member that supports the contact member.

FIG. 10 is a schematic diagram illustrating a roller-shaped contact member and a support member that supports the contact member. Although FIG. 10 shows, as an example, the contact member 54J illustrated in FIG. 9B having the outer peripheral surface 549 curved such that the contact member 54J is thinned toward the center, the roller may have another shape.

FIG. 10 illustrates a support member 57 that supports the contact member 54J. The support member 57 is fixed to the transfer device support frame 501 illustrated in FIGS. 2 and 3. The support member 57 includes two arms 571 and 572, and the contact member 54J is rotatably supported by the support member 57 with the arms 571 and 572 serving as bearings.

As described above, the endmost portion 531 of the transfer belt 53 is bent in a direction such that the endmost portion 531 becomes parallel to the rotating shaft 511 of the transfer roller 51. Therefore, there is a risk that the arm 572 that serves as a bearing for the contact member 54J at a side close to the endmost portion 531 will come into contact with the endmost portion 531 of the transfer belt 53 and damage the transfer belt 53. The arm 572 needs to be shaped so as to not come into contact with the transfer belt 53.

Referring to FIGS. 2 and 3 again, the positions at which the contact members 54 may be disposed will be described.

The contact members 54 are members that press the transfer belt 53 against a member that face the contact members 54 with the transfer belt 53 interposed therebetween. Therefore, a backing member to be pressed against the back side of the transfer belt 53 is required. As shown in FIG. 3, in which the contact members 54 are shown by the solid lines, the transfer roller 51 is used as the backing member in the present exemplary embodiment. The transfer roller 51 is a roller that drives the transfer belt 53, that is, a roller that applies tension to the transfer belt 53. Accordingly, the contact members 54 are capable of resisting a greater force that causes a lateral deviation of the transfer belt 53 than are contact members 54' shown by the dotted lines disposed on the separation roller 52, which is a driven roller.

In FIG. 3, the contact members 54' shown by the dotted lines overlap the separation roller 52 over the entire regions thereof. This will be described below with reference to FIG. 11.

When the contact members 54 are provided on the transfer roller 51, as illustrated in FIG. 2, each contact member 54 is preferably disposed on a left half of the transfer roller 51 in FIG. 2 that is in contact with the transfer belt 53 at a position shifted from the most downstream position toward the most upstream position in the direction in which the transfer belt 53 rotates. More specifically, in the present exemplary embodiment, unlike a contact member 54" illustrated in FIG. 2, which is disposed at the most downstream side, the contact member 54 is positioned near the most upstream position. This is because the tension applied to the transfer belt 53 is greater at the most upstream side, and the contact member 54 disposed at a position where the transfer belt 53 receives a large tension is capable of resisting a greater force that causes a lateral deviation of the transfer belt 53.

Figure 11:
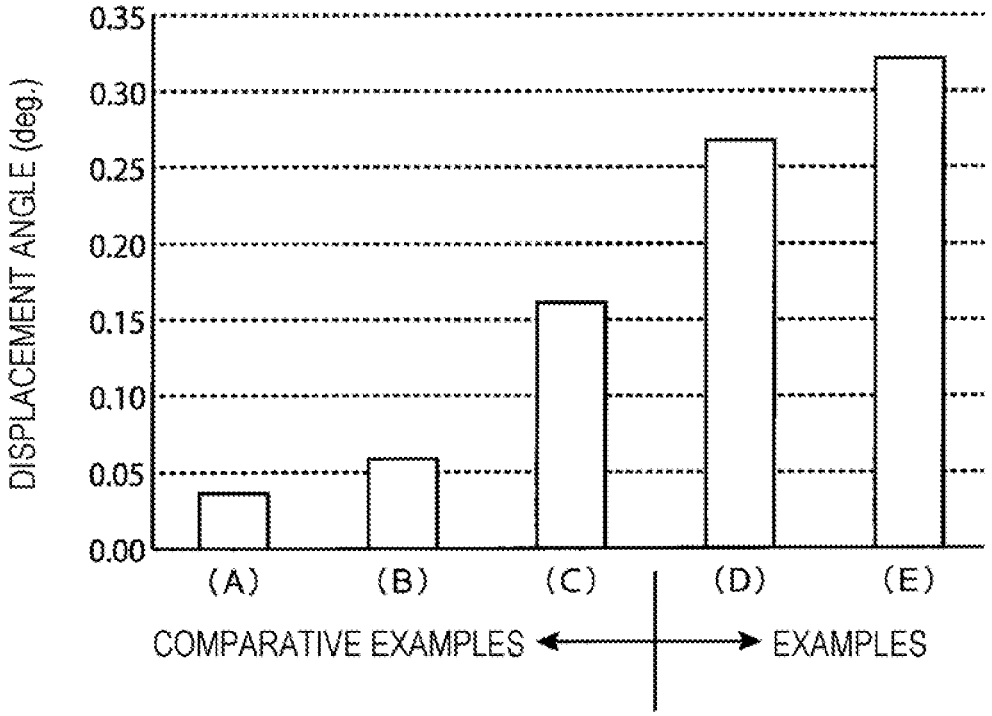
FIG. 11 is a graph showing an example of experiment data.

FIG. 11 is a graph showing an example of experiment data.

The vertical axis represents the inclination angle of the rotating shaft 521 of the separation roller 52 with respect to the rotating shaft 511 of the transfer roller 51. Also, (A) on the horizontal axis shows the case in which no contact members are provided; (B) and (C) the cases in which rollers having the structure illustrated in FIG. 4A are provided, each roller being cylindrical and having a diameter that is constant in the direction of the rotational axis 591; and (D) and (E) the cases in which rollers having the structure illustrated in FIG. 9B are provided, each roller having the outer peripheral surface 549 that is curved such that the roller is thinned toward the center in the direction of the rotational axis 545. Here, (B) and (D) are the cases in which the rollers are provided on the separation roller 52 as the contact members 54' shown by the dotted lines in FIGS. 2 and 3, and (C) and (E) are the cases in which the rollers are provided on the transfer roller 51 as the contact members 54 shown by the solid lines in FIGS. 2 and 3. When the contact members 54' are provided on the separation roller 52, the transfer roller and the separation roller are formed such that the lengths L1 and L2 thereof in FIG. 3 are reversed, that is, such that the transfer roller has the length L2 and the separation roller has the length L1. Accordingly, in this case, the positional relationship between the separation roller 52 and the contact members 54' shown by the dotted lines in FIG. 3 is similar to the positional relationship between the transfer roller 51 and the contact members 54 shown by the solid lines in FIG. 3.

In FIG. 11, (A) to (C) correspond to comparative examples, and (D) and (E) correspond to examples of the present exemplary embodiment.

As is clear from FIG. 11, when the rollers which each have the outer peripheral surface 549 curved such that the roller is thinned toward the center in the direction of the rotational axis 545 are provided, the lateral deviation of the transfer belt 53 can be reduced even when the inclination angle of the rotating shaft 521 of the separation roller 52 is large. In addition, a comparison between (D) and (E) shows that the inclination angle for which the lateral deviation can be reduced is greater when the rollers are provided on the transfer roller 51, which is a driving roller, than when the rollers are provided on the separation roller 52, which is a driven roller.

Although FIGS. 5A to 9B illustrate the contact members 54A to 54H having various shapes, the contact member according to the present disclosure is not limited to contact members having these shapes. As described in the present exemplary embodiment, referring to FIG. 4B, the contact member may have any shape as long as the contact member at least has a first contact point at which the contact member is in contact with the transfer belt and presses the transfer belt against the transfer roller or the separation roller and a second contact point that is closer to an end portion of the transfer belt 53 in the width direction than the first contact point is and at which the contact member is in contact with the transfer belt such that an angle between the contact member and the rotating shaft of either the transfer roller or the separation roller is greater than that at the first contact point.

Although an image forming apparatus having an electrophotographic system is described as an example in the above-described exemplary embodiment, the present disclosure may be applied to a transfer device and an image forming apparatus other than those having an electrophotographic system. For example, the present disclosure may be applied to an inkjet image forming apparatus. More specifically, the present disclosure may be applied to an image forming apparatus that forms an ink image on an intermediate transfer body by using an inkjet head and transfers the ink image from the intermediate transfer body to a paper sheet.

The present disclosure may also be applied to an image forming apparatus having another system as long as the image forming apparatus transfers an image to a recording medium.

In addition, the present disclosure may also be applied to a belt member other than a transfer belt of an image forming apparatus. For example, the present disclosure may also be applied to a transport device disposed between the transfer device and the fixing device.

Furthermore, the present disclosure may also be applied to a belt member other than those included in an image forming apparatus.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A belt driving device comprising:

a belt member that is loop-shaped;

a plurality of rotating members around which the belt member extends, each rotating member rotating about a rotating shaft that extends in a width direction of the belt member; and contact members disposed at both sides of the belt member in the width direction, the contact members being in contact with the belt member and reducing a deviation of the belt member in the width direction, wherein the plurality of rotating members include at least one first rotating member, a portion of the first rotating member that is in contact with the belt member having a dimension less than a width of the belt member in a direction of the rotating shaft so that end portions of the belt member in the width direction are spaced from the first rotating member, and wherein each contact member has at least a first contact point at which the contact member is in contact with the belt member and presses the belt member against the first rotating member and a second contact point that is closer to a corresponding one of the end portions in the width direction than the first contact point is and at which the contact member is in contact with the belt member such that an angle between the contact member and the rotating shaft at the second contact point is greater than an angle between the contact member and the rotating shaft at the first contact point, wherein each contact member is disposed in a region in which the belt member is in contact with the first rotating member at a position closer to a most upstream position than a most downstream position is in a direction in which the belt member rotates.

2. The belt driving device according to claim 1, wherein each contact member is a rotating contact member that rotates about a rotating shaft of the rotating contact member and that includes portions arranged in a direction of the rotating shaft and having different diameters.

3. The belt driving device according to claim 2, wherein the rotating contact member includes end portions and a central portion in the direction of the rotating shaft of the rotating contact member, the central portion having a diameter less than a diameter of the end portions.

4. The belt driving device according to claim 3, wherein the rotating contact member has an outer peripheral surface that is curved such that the rotating contact member is thinned toward a center of the rotating contact member in the direction of the rotating shaft of the rotating contact member.

5. The belt driving device according to claim 4, wherein the rotating shaft of the rotating contact member is supported by a bearing shaped such that the bearing is not in contact with the belt member.

6. The belt driving device according to claim 5, wherein the first rotating member is a rotational driving member that drives the belt member to rotate the belt member.

7. The belt driving device according to claim 4, wherein the first rotating member is a rotational driving member that drives the belt member to rotate the belt member.

8. The belt driving device according to claim 3, wherein the rotating shaft of the rotating contact member is supported by a bearing shaped such that the bearing is not in contact with the belt member.

9. The belt driving device according to claim 8, wherein the first rotating member is a rotational driving member that drives the belt member to rotate the belt member.

10. The belt driving device according to claim 3, wherein the first rotating member is a rotational driving member that drives the belt member to rotate the belt member.

11. The belt driving device according to claim 2, wherein the rotating shaft of the rotating contact member is supported by a bearing shaped such that the bearing is not in contact with the belt member.

12. The belt driving device according to claim 11, wherein the first rotating member is a rotational driving member that drives the belt member to rotate the belt member.

13. The belt driving device according to claim 2, wherein the first rotating member is a rotational driving member that drives the belt member to rotate the belt member.

14. The belt driving device according to claim 1, wherein the first rotating member is a rotational driving member that drives the belt member to rotate the belt member.

15. A transfer device comprising:

a belt member that is loop-shaped, the belt member having an outer peripheral surface that comes into contact with a recording medium and transferring an image to the recording medium when a voltage is applied thereto;

a plurality of rotating members around which the belt member extends, each rotating member rotating about a rotating shaft that extends in a width direction of the belt member; and contact members disposed at both sides of the belt member in the width direction, the contact members being in contact with the belt member and reducing a deviation of the belt member in the width direction, wherein the plurality of rotating members include at least one first rotating member, a portion of the first rotating member that is in contact with the belt member having a dimension less than a width of the belt member in a direction of the rotating shaft so that end portions of the belt member in the width direction are spaced from the first rotating member, and wherein each contact member has at least a first contact point at which the contact member is in contact with the belt member and a second contact point that is closer to a corresponding one of the end portions in the width direction than the first contact point is and at which the contact member is in contact with the belt member such that an angle between the contact member and the rotating shaft at the second contact point is greater than an angle between the contact member and the rotating shaft at the first contact point, wherein each contact member is disposed in a region in which the belt member is in contact with the first rotating member at a position closer to a most upstream position than a most downstream position is in a direction in which the belt member rotates.

16. An image forming apparatus comprising:

a transport unit that transports a recording medium;

an image forming unit that forms a toner image; and the transfer device according to claim 15, the transfer device transferring the toner image formed by the image forming unit to the recording medium transported by the transport unit.

17. A belt driving device comprising:

a belt member that is loop-shaped;

a plurality of rotating members around which the belt member extends, each rotating member rotating about a rotating shaft that extends in a width direction of the belt member; and contact members disposed at both sides of the belt member in the width direction, the contact members being in contact with the belt member and reducing a deviation of the belt member in the width direction, wherein the plurality of rotating members include at least one first rotating member, a portion of the first rotating member that is in contact with the belt member having a dimension less than a width of the belt member in a direction of the rotating shaft so that end portions of the belt member in the width direction are spaced from the first rotating member, and wherein each contact member has at least a first contact point at which the contact member is in contact with the belt member and presses the belt member against the first rotating member and a second contact point that is closer to a corresponding one of the end portions in the width direction than the first contact point is and at which the contact member is in contact with the belt member such that an angle between the contact member and the rotating shaft at the second contact point is greater than an angle between the contact member and the rotating shaft at the first contact point;

wherein the plurality of rotating members include a second rotating member that supports the belt member together with the first rotating member, a portion of the second rotating member that is in contact with the belt member being longer in the width direction than the portion of the first rotating member that is in contact with the belt member.

* * * * *